US010101073B2

(12) United States Patent
Otsuki et al.

(10) Patent No.: US 10,101,073 B2
(45) Date of Patent: Oct. 16, 2018

(54) DRUG REFRIGERATOR

(71) Applicant: Panasonic Healthcare Co., Ltd., Ehime (JP)

(72) Inventors: Takao Otsuki, Ehime (JP); Kenichi Mizumoto, Ehime (JP)

(73) Assignee: Panasonic Healthcare Holdings Co., Ltd., Tokyo (JP)

( * ) Notice: Subject to any disclaimer, the term of this patent is extended or adjusted under 35 U.S.C. 154(b) by 847 days.

(21) Appl. No.: 14/479,005

(22) Filed: Sep. 5, 2014

(65) Prior Publication Data

US 2014/0373567 A1 Dec. 25, 2014

Related U.S. Application Data

(63) Continuation of application No. PCT/JP2013/001375, filed on Mar. 6, 2013.

(30) Foreign Application Priority Data

Mar. 7, 2012 (JP) ..... 2012-050606

(51) Int. Cl.
*F25D 11/00* (2006.01)
*F25D 17/04* (2006.01)
*F25D 17/06* (2006.01)

(52) U.S. Cl.
CPC ..... *F25D 11/00* (2013.01); *F25D 17/04* (2013.01); *F25D 17/06* (2013.01); *F25D 17/062* (2013.01);
(Continued)

(58) Field of Classification Search
CPC ..... F25D 11/00; F25D 17/04; F25D 17/06; F25D 17/062; F25D 2317/0655; F25D 2317/0672; F25D 2317/0661
(Continued)

(56) References Cited

U.S. PATENT DOCUMENTS 3,093,981 A * 6/1963 O'Grady ..... F25D 17/045 62/408
3,403,533 A * 10/1968 Bollenbacher ..... F25D 17/065 62/408
(Continued)

FOREIGN PATENT DOCUMENTS

JP 57-093785 U 6/1982
JP 57-196970 U 12/1982
(Continued)

*Primary Examiner* — Emmanuel Duke
(74) *Attorney, Agent, or Firm* — McDermott Will & Emery LLP

(57) ABSTRACT

A drug refrigerator capable of temperature control with a small fluctuation range in interior temperature is provided. This is the drug refrigerator in which cold air in a cooling chamber partitioned by a vertical partition plate in the back of an interior is circulated into the interior by a fan. A cold air inlet is formed above the center of the vertical partition plate. At right and left positions lower than a cooler in the cooling chamber, forward-facing cold air outlets are provided. A downward-facing cold air outlet for blowing out cold air toward a bottom part of the interior is provided at a position lower than the forward-facing cold air outlets. The circulation amount of cold air blown out through the forward-facing cold air outlet is made larger than the circulation amount of cold air blown out through the downward-facing cold air outlet.

7 Claims, 8 Drawing Sheets

(52) U.S. Cl.
CPC ..... *F25D 2317/0655* (2013.01); *F25D 2317/0661* (2013.01); *F25D 2317/0672* (2013.01)

(58) Field of Classification Search
USPC ..... 62/419
See application file for complete search history.

(56) References Cited

U.S. PATENT DOCUMENTS

| | | | | | |
|---|---|---|---|---|---|
| 3,590,596 | A * | 7/1971 | Johnson | F25D 17/065 | 62/275 |
| 4,353,223 | A * | 10/1982 | Dienemann | F25D 11/022 | 62/442 |
| 4,704,874 | A * | 11/1987 | Thompson | F25D 17/065 | 62/187 |
| 6,381,982 | B1 * | 5/2002 | Kim | F25D 17/065 | 62/407 |
| 7,243,506 | B2 * | 7/2007 | Spillner | A47F 3/0447 | 62/258 |
| 2008/0202149 | A1 * | 8/2008 | Lim | F25D 17/062 | 62/407 |

FOREIGN PATENT DOCUMENTS

| | | | | |
|---|---|---|---|---|
| JP | 07-019717 | A | 1/1995 | |
| JP | 11-132625 | A | 5/1999 | |
| JP | 2004-144364 | A | 5/2004 | |
| JP | 2005-030634 | A | 2/2005 | |
| JP | 2005-345062 | A | 12/2005 | |
| WO | WO 2008095754 | A1 * | 8/2008 | F25D 17/042 |

* cited by examiner

DRUG REFRIGERATOR

RELATED APPLICATIONS

This application is continuation of International Application No. PCT/JP2013/001375, filed on Mar. 6, 2013, which in turn claims the benefit of Japanese Application No. 2012-050606, filed on Mar. 7, 2012, the disclosures of which Applications are incorporated by reference herein.

TECHNICAL FIELD

The disclosed technique relates to a drug refrigerator for housing and storing vaccines, drugs, samples, and the like, so as to be kept at a low temperature.

BACKGROUND ART

A conventionally existing drug refrigerator houses and stores vaccines, drugs, samples, and the like, in an interior of a refrigerator body so as to be kept at a low temperature. In order to maintain a good storage state thereof, it is necessary to keep an interior temperature in the refrigerator body within a predetermined temperature range (see Patent Literature 1).

According to one control method for cooling the interior temperature to a predetermined temperature, if the interior preset temperature is set at 5° C., for example, control is performed in such a manner that a cooling device (including an electric compressor and a cold air circulation fan) is operated when the interior temperature is increased to the upper limit temperature set in a temperature control device whereas the cooling device is stopped when the interior temperature is decreased to the lower limit temperature set in the temperature control device, whereby the average temperature in the interior becomes equal to 5° C.

According to another control method, the cooling device is operated with an inverter control method. If the interior preset temperature is set at 5° C., control is performed in such a manner that an operation frequency of the cooling device is increased to obtain a high-speed operation state as the interior temperature is increased toward the upper limit temperature set in the temperature control device whereas the operation frequency of the cooling device is decreased to obtain a low-speed operation state as the interior temperature is decreased toward the lower limit temperature set in the temperature control device.

CITATION LIST

Patent Literature

Patent Literature 1: Japanese Patent Application Laid-Open No. Hei. 7-019717

SUMMARY OF INVENTION

Technical Problem

With either method described above, it is difficult to cause all areas in the interior of the refrigerator body to achieve the preset temperature of 5° C. If the interior preset temperature is set at 5° C., for example, control is performed so that the average temperature in the interior fluctuating between the upper limit temperature and the lower limit temperature becomes equal to 5° C. However, a fluctuation range in interior temperature is prescribed depending on what is stored in the interior. For example, with regard to the storage of vaccines, a storage temperature range thereof is prescribed by each country. As one example, if vaccines are to be stored at the interior temperature of 5° C., the vaccines may be allowed to be stored within a range of the interior preset temperature 5° C.±5° C. in one country. In another country, it may be prescribed more strictly that the vaccines should be kept within a range of 5° C.±3° C.

Especially when the interior in the refrigerator body has a front-face opening and a part or a large part of a door for opening and closing the front-face opening thereof is formed by a glass window, an area near the front-face opening in the interior tends to have a higher temperature than the back area or lower area in the interior. Moreover, in order to prevent dew condensation on portions near the front-face opening of the refrigerator body and the front face and glass window of the door, a heating means is provided to heat those portions by disposing an electric heater and/or a hot gas pipe of the cooling device. As such, the area near the front-face opening in the interior has a higher temperature than the back area and lower area in the interior. Thus, variations in interior temperature become large, thereby making it difficult to keep the whole area of the interior within the predetermined temperature range.

In view of this, it is an object of the disclosed technique to provide a drug refrigerator requiring temperature control with a small fluctuation range in interior temperature even when a part or a large part of a door is formed by a glass window as well as when the entire door is made of a heat-insulating door.

Solution to Problem

An effective technical means for achieving such an object will be described below.

A drug refrigerator of the disclosed technique includes: a refrigerator body with an approximately rectangular parallelepiped shape having an opening on a front face thereof and having a heat insulating property; a door capable of opening and closing the opening; a vertical partition plate for forming a cooling chamber in a vertical direction along a back wall of the refrigerator body in a back part of an interior of the refrigerator body; a cooler housed in the cooling chamber; and a cold air circulation fan provided at a position higher than the cooler in the cooling chamber, the cold air circulation fan circulating cold air cooled by the cooler into the interior. The vertical partition plate is provided with: a cold air inlet disposed at a position facing the cold air circulation fan, the cold air being sucked in through the cold air inlet in the interior by the cold air circulation fan; forward-facing cold air outlets disposed at right and left positions lower than the cooler, the cold air being blown out through the forward-facing cold air outlets toward a front part of the interior; and a downward-facing cold air outlet disposed at a position lower than the forward-facing cold air outlets, the cold air being blown out through the downward-facing cold air outlet toward a bottom part of the interior from a lower part of the cooling chamber. The forward-facing cold air outlets are formed larger than the downward-facing cold air outlet such that a circulation amount of the cold air blown out through the forward-facing cold air outlets is greater than a circulation amount of the cold air blown out through the downward-facing cold air outlet.

Advantageous Effects of Invention

According to the disclosed technique, it is possible to provide the drug refrigerator requiring temperature control with a small fluctuation range in interior temperature even when a part or a large part of the door is formed by a glass window as well as when the entire door is made of a heat-insulating door.

DESCRIPTION OF EMBODIMENTS

A drug refrigerator of the disclosed technique is configured such that: a cooling chamber with a front face thereof being covered by a vertical partition plate is formed, in a back part of a rectangular parallelepiped interior formed in a heat-insulating refrigerator body having a front-face opening to be opened and closed by a door, in a vertical direction along a back wall of the refrigerator body; and a cooler is housed in the cooling chamber and cold air cooled by the cooler is circulated into the interior by a cold air circulation fan. In the vertical partition plate, a cold air inlet is formed in an upper part thereof at a center of the interior in a horizontal direction so as to be positioned higher than the cooler. The cold air circulation fan is disposed corresponding to the cold air inlet. Forward-facing cold air outlets through which cold air is blown out toward a front part of the interior are provided at right and left positions of the vertical partition plate lower than the cooler. A downward-facing cold air outlet located at a position lower than the forward-facing cold air outlets is provided in order to blow out cold air therethrough toward a bottom part of the interior from a lower part of the cooling chamber. The downward-facing cold air outlet and the forward-facing cold air outlets are configured such that a circulation amount of the cold air blown out through the forward-facing cold air outlets is greater than a circulation amount of the cold air blown out through the downward-facing cold air outlet. Consequently, temperature variations from the upper part to the lower part of the interior fall within a predetermined temperature variation range with respect to a preset temperature. An embodiment thereof will be described below.

[First Embodiment]

A drug refrigerator 1 according to the disclosed technique is provided for housing and storing vaccines, drugs, samples, and the like, so as to be kept at a low temperature. Depending on what is housed in the drug refrigerator 1, the low temperature set for such storage varies. However, the drug refrigerator 1 having a cooling ability to maintain a temperature range of 2° C. to 14° C., for example, will be described as an embodiment.

Figure 1:
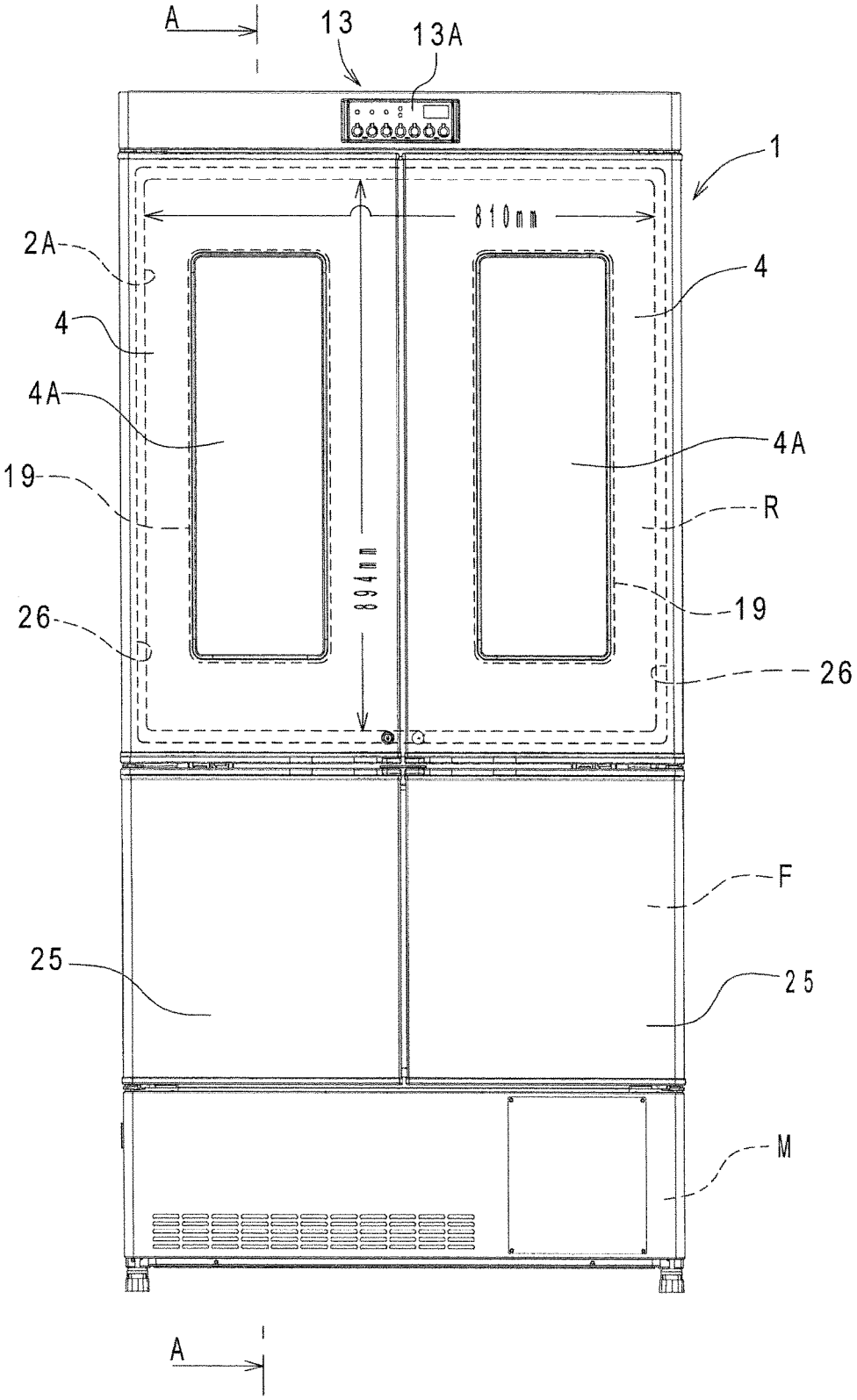
FIG. 1 is a front view of a drug refrigerator according to an embodiment.
Figure 2:
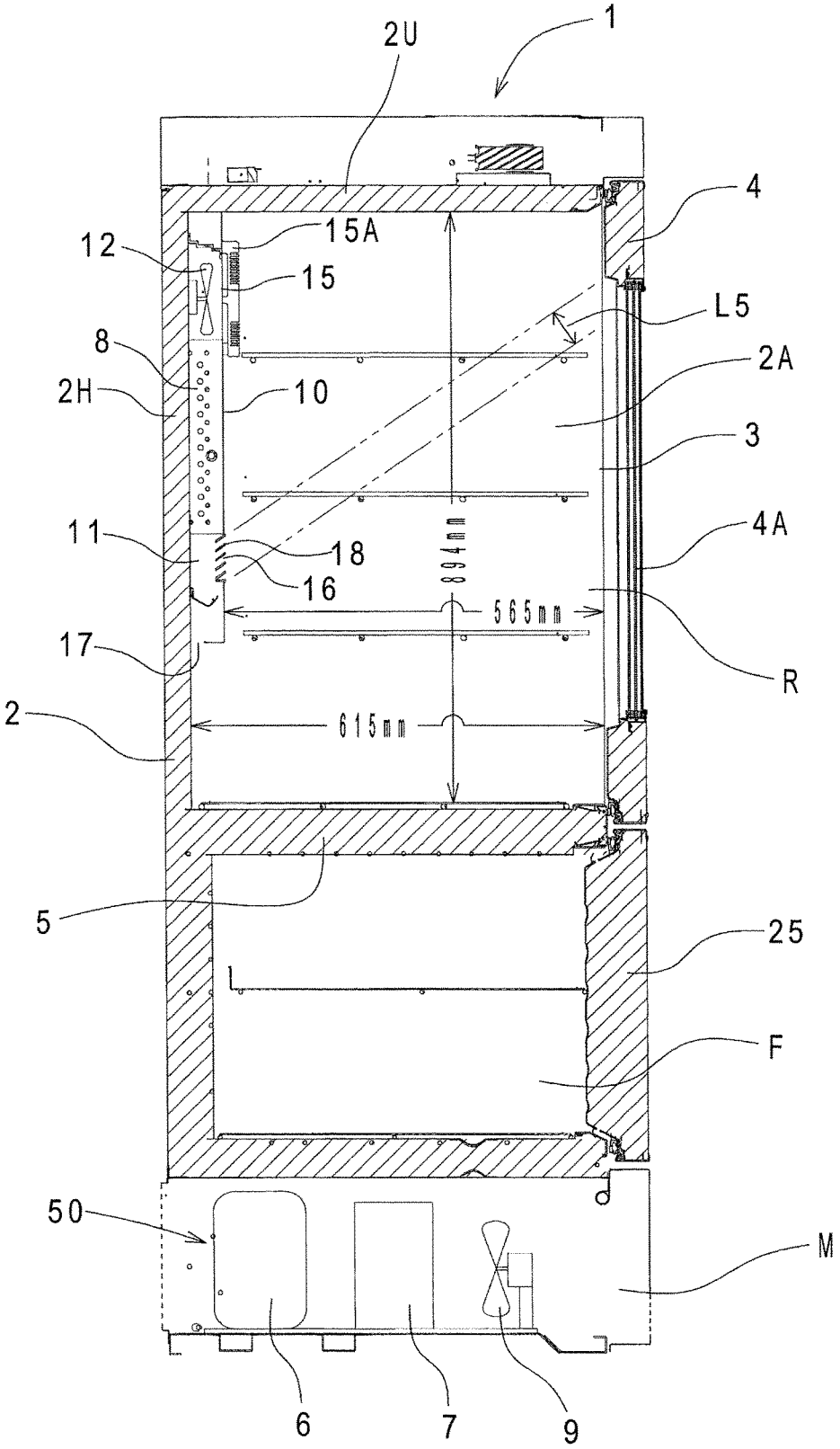
FIG. 2 is a cross-sectional view taken along line A-A in FIG. 1.

As shown in FIGS. 1 and 2, the illustrated drug refrigerator 1 according to the disclosed technique is in the form of the drug refrigerator 1 with a freezer. The drug refrigerator 1 with a freezer is configured such that: a drug refrigerator part R according to the disclosed technique is disposed in the upper part thereof; a freezer F partitioned by a heat-insulating partition wall 5 is disposed thereunder; and a machine chamber M is disposed in the lowest part thereof. The drug refrigerator 1 according to the disclosed technique may or may not take the form with the freezer. Thus, the drug refrigerator part R to be the subject of the drug refrigerator 1 according to the disclosed technique will be described in detail.

Figure 3:
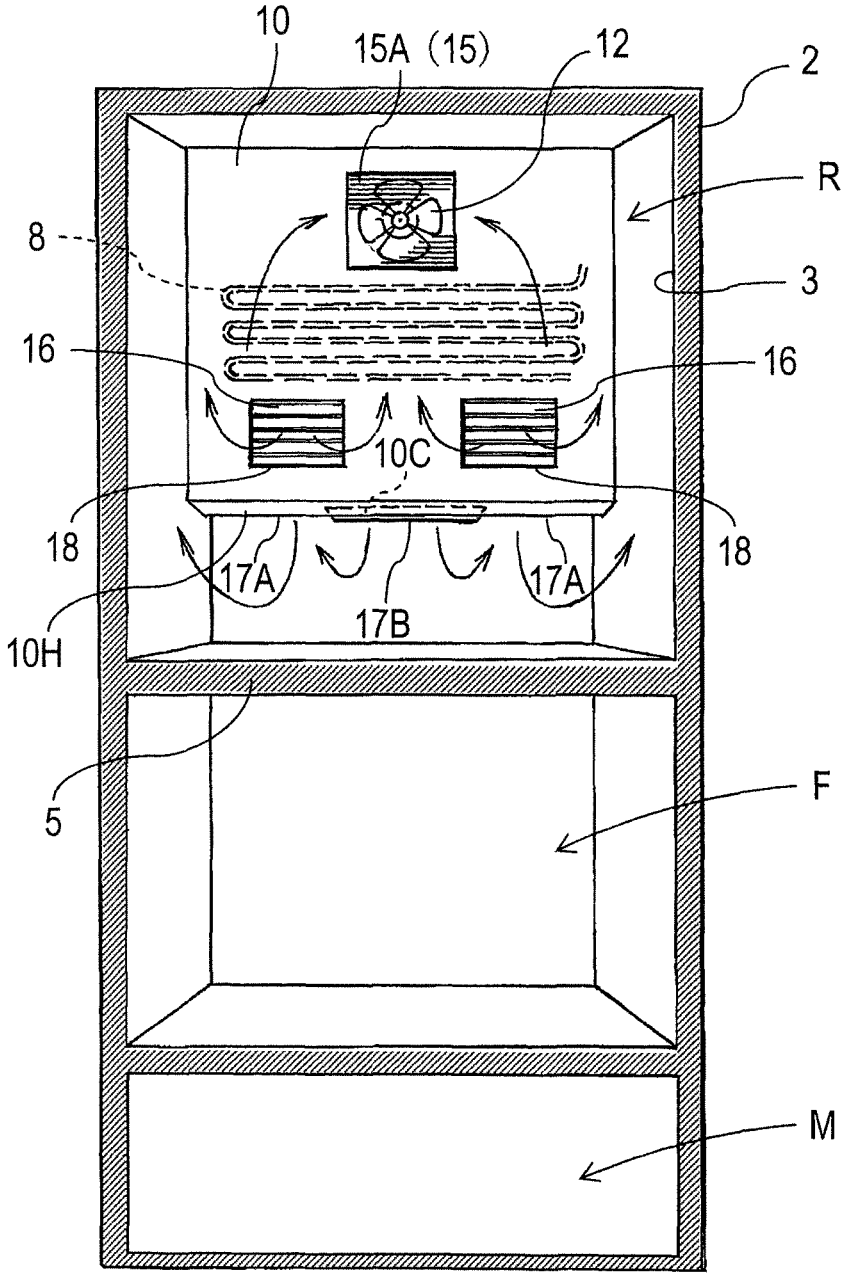
FIG. 3 is an explanatory diagram of the inside of a refrigerator body as viewed from the front according to the embodiment.

The drug refrigerator part R according to the disclosed technique will now be described below in detail. As shown in FIGS. 1 to 3, the drug refrigerator part R includes: a heat-insulating refrigerator body 2 in the shape of a vertically-long rectangular parallelepiped having an opening 3 on a front face thereof; and heat-insulating doors 4 for opening and closing the front-face opening 3. An interior 2A in the shape of a vertically-long rectangular parallelepiped formed inside the refrigerator body 2 is kept at a predetermined low temperature by a refrigeration device 50. The illustrated doors 4 have a configuration of a double door 4 which opens toward right and left to expose the front-face opening 3. The right and left doors 4 each have, in a central portion thereof, a vertically-long heat-insulating window 4A covered by a double or triple-glazed see-through glass.

The refrigeration device 50 is a known refrigerating system for performing a cycle during which: a predetermined refrigerant is compressed by a compressor 6; the compressed high-pressure refrigerant is condensed by a condenser 7; the condensed refrigerant is depressurized in a decompressor (not shown) and then evaporated in an evaporator constituting a cooler 8; and the refrigerant after the evaporation is compressed again by the compressor 6 and condensed by the condenser 7. The compressor 6 and the condenser 7 are disposed in the machine chamber M and heat release thereof is performed by a heat release fan 9 disposed in the machine chamber M.

A cooling chamber 11 covered by a vertical partition plate 10 with a size extending across the horizontal width of the interior 2A is formed in a back part of the rectangular parallelepiped interior 2A. The vertical partition plate 10 is attached in an approximately vertical state across the horizontal width of the interior 2A so as to be parallel to a back wall 2H of the refrigerator body 2. Employed is a configuration with an indirect cooling system in which the cooler 8 is housed in the cooling chamber 11 and cold air cooled by the cooler 8 is circulated into the interior 2A by a cold air circulation fan 12.

In order to maintain a temperature in the interior 2A at a predetermined temperature set by a temperature control device 13A provided in a control part 13 disposed in an upper portion of the drug refrigerator 1, operations of the refrigeration device 50 and the cold air circulation fan 12 are controlled by the temperature control device 13A while detecting the temperature in the interior 2A by a temperature detection sensor (not shown) connected to the temperature control device 13A.

In this case, if an interior preset temperature set by the temperature control device 13A (a temperature set as desired by a user of the drug refrigerator 1) is set at 5° C., for example, the temperature in the interior 2A is controlled in such a manner that the temperature control device 13A is operated according to the temperature in the interior 2A detected by the temperature detection sensor, to control the operations of the refrigeration device 50 and the cold air circulation fan 12, whereby the temperature in the interior 2A is varied between an upper limit temperature and a lower limit temperature set in the temperature control device 13A and an average temperature thereof becomes equal to 5° C.

It is an object of the disclosed technique to provide the drug refrigerator 1 requiring temperature control with a small fluctuation range in interior temperature, for example, the preset temperature 5° C.±3° C., even when a part or a large part of the door is formed by the glass window 4A as well as when the entire door 4 is made of a heat-insulating door. In order to achieve this object, there is provided a configuration of a cold air circulation path with which temperature variations in all areas of the interior 2A fall within the predetermined temperature fluctuation range (within the range of the preset temperature 5° C.±3° C., for example).

As compared to the case where the interior 2A has the front-face opening 3 as described above and the entire door 4 for opening and closing the front-face opening 3 is made of a heat-insulating door, an area near the front-face opening 3 in the interior 2A tends to have a higher temperature than the back area or lower area in the interior 2A if a part or a large part of the door 4 for opening and closing the front-face opening 3 is formed by the glass window 4A. Moreover, in order to prevent dew condensation on portions near the front-face opening 3 of the refrigerator body 2 and the front face and glass window 4A of the door 4, a heating means is provided to heat those portions by disposing an electric heater 19 and a high-temperature refrigerant gas pipe 26 of the refrigeration device 50. As such, while the back area and the lower area in the interior 2A can be kept within the predetermined temperature range, the area near the front-face opening 3 in the interior 2A has a higher temperature than the back area and lower area in the interior 2A. Thus, temperature variations in the interior 2A become large, thereby making it difficult to keep the whole area of the interior 2A within the predetermined temperature range (5° C.±3° C. in this embodiment).

Therefore, according to the disclosed technique, a special configuration is employed for cold air circulation in the interior 2A in order to keep the interior 2A within the predetermined temperature range, for example, within the range of 5° C.±3° C. when the interior preset temperature is set at 5° C. As shown in FIG. 3, etc., a cold air inlet 15 is formed in the vertical partition plate 10 so as to be located in an upper part thereof at the center of the interior 2A in the horizontal direction and to be located higher than the cooler 8. The cold air circulation fan 12 is disposed corresponding to the cold air inlet 15. Also, forward-facing cold air outlets 16 through which cold air is blown out toward the front part of the interior 2A are formed on the right and left sides at right and left positions of the vertical partition plate 10 lower than the cooler 8. A downward-facing cold air outlet 17 through which cold air is blown out toward the bottom part of the interior 2A from a lower part of the cooling chamber 11 is further formed at a position lower than the forward-facing cold air outlets 16. The reason why the vertical partition plate 10 is terminated at a position above the lower end of the interior 2A is to form an interior part larger by the depth dimension of the cooling chamber 11 in the lower part of the interior 2A and thereby increase the storage capacity of the interior 2A.

As a preferred form therefor, when the vertical dimension of the interior 2A is quartered and the quartered areas are referred to as a first area, a second area, a third area, and a fourth area in order from the top, the right and left forward-facing cold air outlets 16, 16 and the downward-facing cold air outlet 17 are disposed in the third area. Note however that it is effective when at least a part of the forward-facing cold air outlets 16, 16 and the downward-facing cold air outlet 17 are provided at positions lower than the center of the interior 2A in the vertical direction. Moreover, the right and left forward-facing cold air outlets 16, 16 are formed at the right and left positions outside an area directly under the cold air inlet 15. Moreover, the downward-facing cold air outlet 17 includes: a central outlet part 17B corresponding to the area directly under the cold air inlet 15; and right and left outlet parts 17A corresponding to areas under the right and left forward-facing cold air outlets 16, 16. The downward-facing cold air outlet 17 is configured such that the blown-out cold air travels along the back wall 2H of the refrigerator body 2 in the vertical direction.

Moreover, the downward-facing cold air outlet 17 and the forward-facing cold air outlets 16 are configured such that the circulation amount of the cold air blown out through the forward-facing cold air outlets 16 is greater than the circulation amount of the cold air blown out through the downward-facing cold air outlet 17. Furthermore, the downward-facing cold air outlet 17 and the forward-facing cold air outlets 16 are configured such that temperature unevenness between the upper area and the lower area of the interior 2A is reduced, so that temperature variations in all areas from the upper part to the lower part of the interior 2A fall within a predetermined temperature variation range (±3° C. in this embodiment) with respect to the preset temperature (5° C. in this embodiment).

Figure 5:
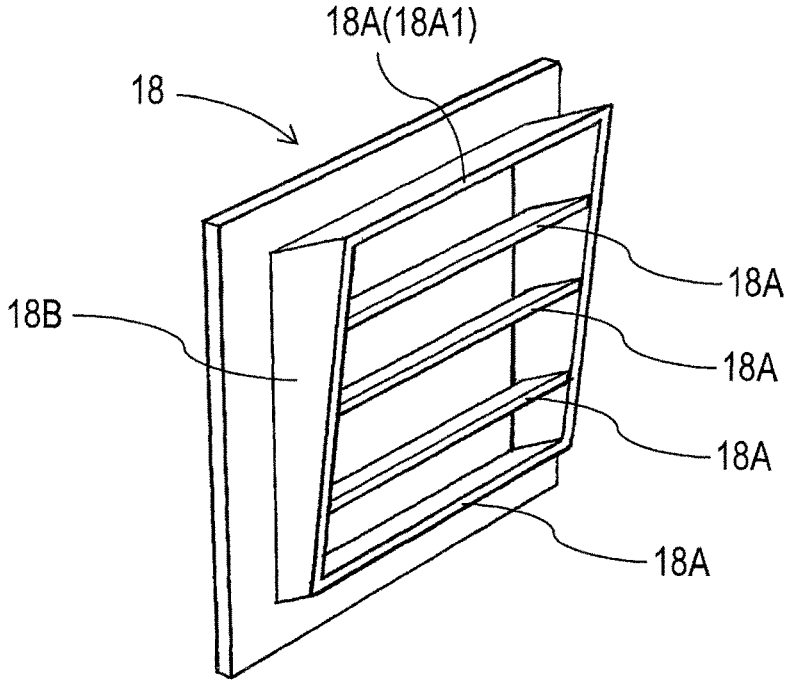
FIG. 5 is a perspective view of a forward-facing cold air outlet according to the embodiment.
Figure 6:
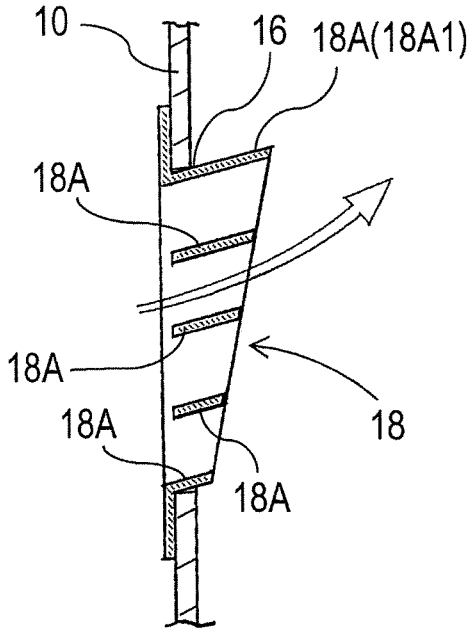
FIG. 6 is a vertical cross-sectional side view of the forward-facing cold air outlet according to the embodiment.

As one configuration therefor, the forward-facing cold air outlet 16 is provided with an outlet member 18 as shown in FIGS. 5 and 6. Here, the outlet member 18 includes a plurality of wind-directing plates 18A extending in the horizontal direction and disposed parallel to each other at predetermined intervals in the vertical direction such that cold air is blown out in an obliquely-upward direction. The outlet member 18 includes the plurality of wind-directing plates 18A with the right and left edges thereof being fixed to a frame part 18B so as to be directed obliquely upward at a predetermined angle. The wind-directing plate 18A is disposed with an upward slope. As indicated by a width L5 in FIG. 2, the wind-directing plate 18A is directed such that the extension of the upward slope corresponds to an area extending from the middle part to the upper part of the door 4.

As a configuration therefor, the wind-directing plates 18A are configured such that the upper wind-directing plates 18A are incrementally projected more toward the interior 2A side than the lower wind-directing plates 18A as shown in FIGS. 5 and 6. This allows part of the cold air flowing downward in the cooling chamber 11 to be blown out into the interior 2A along the respective wind-directing plates 18A obliquely upward in the direction corresponding to the area extending from the middle part to the upper part of the door 4. In this case, due to the forward projection of the uppermost wind-directing plate 18A1, the blown-out cold air is guided forward, thereby increasing a path of the cold air blown out through the forward-facing cold air outlet 16 before being sucked into the cold air inlet 15. Thus, the cold air blown out through the forward-facing cold air outlet 16 is prevented from being immediately sucked into the cold air inlet 15, what is called a short circuit. This is therefore preferable for the purpose of uniformly cooling the interior 2A.

Figure 4:
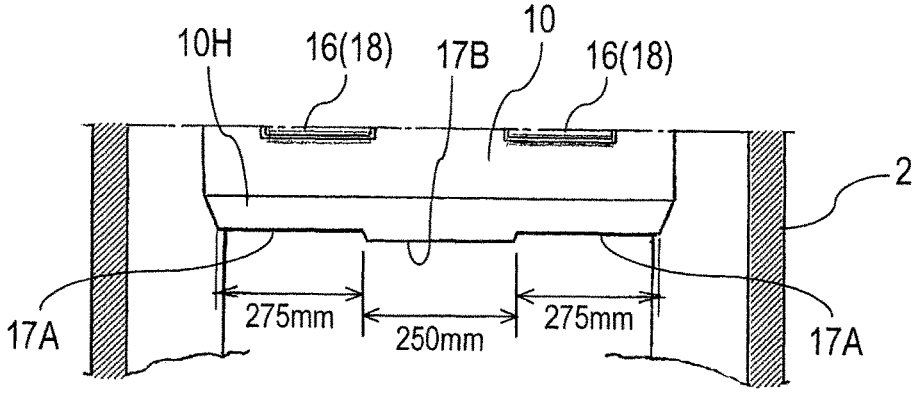
FIG. 4 is an explanatory diagram of a downward-facing cold air outlet part as viewed from the front according to the embodiment.
Figure 7:
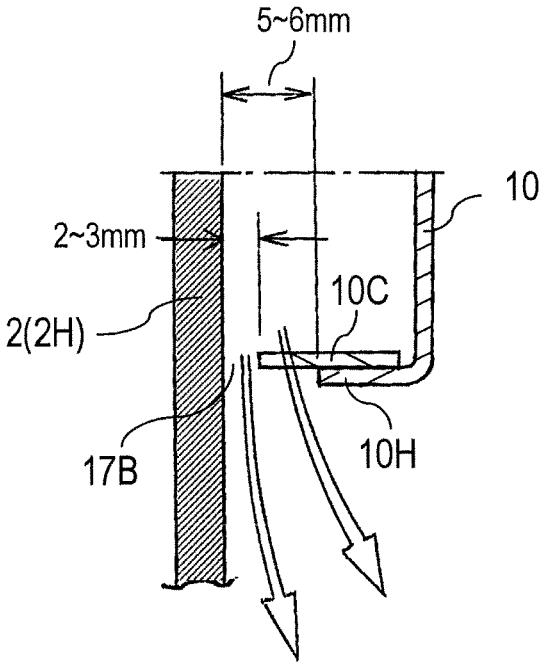
FIG. 7 is a vertical cross-sectional side view of the downward-facing cold air outlet according to the embodiment.

Moreover, as shown in FIGS. 4 and 7, the downward-facing cold air outlet 17 is configured such that the blown-out cold air travels in the vertical direction along the back wall 2H of the refrigerator body 2. The right and left outlet parts 17A corresponding to the areas under the right and left forward-facing cold air outlets 16 each have a larger opening in a front-back direction and the central outlet part 17B corresponding to the area between the right and left forward-facing cold air outlets 16, 16 has a narrower opening in the front-back direction. In the central portion, the cold air passing through the cooler 8 and flowing downward in the cooling chamber 11 by the cold air circulation fan 12 flows downward between the cold air outlets 16, 16 and blows out downward through the central outlet part 17B. In the right and left portions, a majority of such cold air blows out through the cold air outlets 16, 16 and the remaining amount thereof blows out downward through the right and left outlet parts 17A. This is a configuration made to achieve approximate homogenization of temperatures near the downward-facing cold air outlet 17 and in the lower area of the interior 2A by approximately balancing the amount of cold air blown out downward through the central outlet part 17B and the amount of cold air blown out downward through the right and left outlet parts 17A so that the amount of cold air blown out through the downward-facing cold air outlet 17 over the entire horizontal width is approximately balanced across the horizontal width of the interior 2A.

Figure 11:
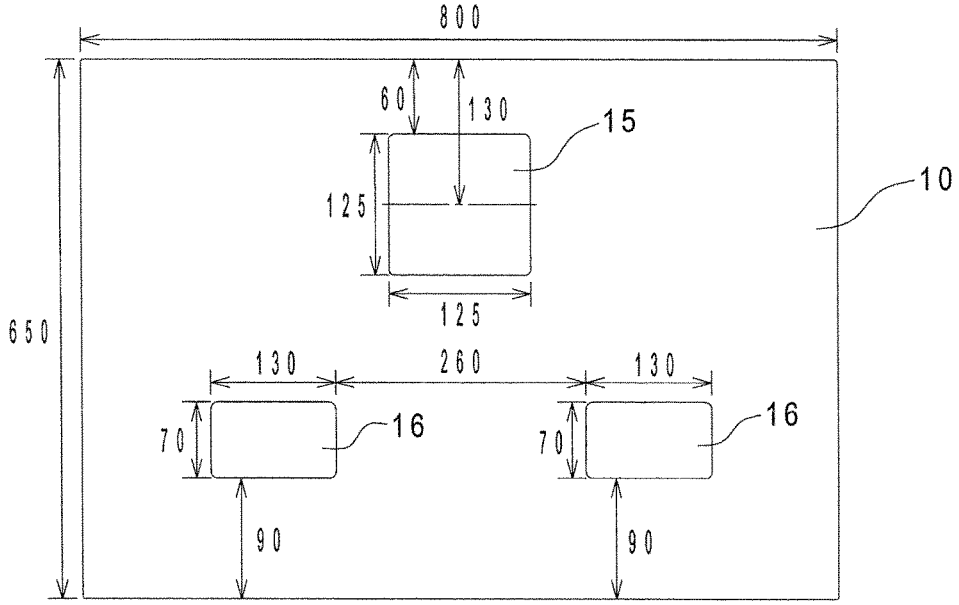
FIG. 11 is a front view of a vertical partition plate for partitioning a cooling chamber of the drug refrigerator according to the embodiment.

As one example of the above-described embodiment, the vertical dimension of the interior 2A is approximately 894 mm and the horizontal width thereof is approximately 810 mm as shown in FIGS. 1 and 2. Moreover, as shown in FIG. 11, the vertical dimension of the vertical partition plate 10 is approximately 650 mm and the horizontal dimension thereof is equal to or slightly smaller (approximately 800 mm) than the horizontal width of the interior 2A. The vertical partition plate 10 is disposed such that the top edge thereof abuts against an upper wall 2U of the interior 2A via a seal material and right and left edges thereof abut against right and left walls 2R and 2L of the interior 2A via the seal material, respectively. Also, the depth dimension from the front-face opening 3 to the vertical partition plate 10 is approximately 565 mm. The depth dimension in the lower part of the interior 2A where no vertical partition plate 10 exists, which is obtained by adding the thickness of the cooling chamber 11 in the front-back direction to the depth dimension from the front-face opening 3 to the vertical partition plate 10, is approximately 615 mm. The reason why the vertical partition plate 10 does not have a length extending across the vertical dimension of the interior 2A is to form the interior part larger by the depth dimension of the cooling chamber 11 in the lower part of the interior 2A.

Also, the cold air inlet 15 is positioned at a central part of the vertical partition plate 10 in the horizontal direction. The cold air inlet 15 is formed to have a square hole of approximately 125 mm at a position lower than a position below the top edge of the vertical partition plate 10 by approximately 60 mm. Also, the right and left forward-facing cold air outlets 16, 16 are each formed to have a horizontally-long quadranglar hole with a vertical dimension of approximately 70 mm and a horizontal width of approximately 130 mm. The lower end of this hole is located at a position away from the lower end of the vertical partition plate 10 by approximately 90 mm and a distance between these holes, i.e., the cold air outlets 16, 16, is 260 mm. Thus, the cold air outlets 16, 16 are disposed in a bilaterally symmetric manner so that the centers of these holes are located at positions away from the center of the vertical partition plate 10 in the horizontal direction by approximately 195 mm. Consequently, the right and left forward-facing cold air outlets 16 are disposed in the areas outside the area directly under the cold air inlet 15; the central outlet part 17B is disposed corresponding to the area directly under the cold air inlet 15; and the right and left outlet parts 17A are disposed corresponding to the areas under the right and left forward-facing cold air outlets 16, 16. At the front face of the cold air inlet 15, an inlet cover 15A is attached to the vertical partition plate 10. Moreover, the outlet members 18 are attached to the right and left cold air outlets 16, 16, respectively.

Furthermore, in the downward-facing cold air outlet 17, the right and left outlet parts 17A on the right and left sides each occupy a horizontal width of 275 mm of the approximately 800 mm horizontal dimension of the vertical partition plate 10 and each have a 5 to 6 mm outlet width in the front-back direction as shown in FIGS. 4 and 7, etc. Also, the central outlet part 17B between the right and left outlet parts 17A has a horizontal width of 250 mm and a 2 to 3 mm outlet width in the front-back direction. This outlet thickness of the right and left outlet parts 17A in the front-back direction (5 to 6 mm) is defined by a gap between a bent side 10H, which is formed by bending the entire lower end of the vertical partition plate 10 backward by approximately 90 degrees, and the back wall 2H of the refrigerator body 2. The outlet width of the central outlet part 17B in the front-back direction (2 to 3 mm) is defined by a gap between an adjusting plate 10C attached to the bent side 10H and the back wall 2H of the refrigerator body 2. Although the right and left edges of the central outlet part 17B are communicated with the right and left outlet parts 17A, respectively, they may be partitioned by partition walls in order to prevent such communication.

With such a configuration, according to one embodiment, approximately two thirds of the amount of cold air circulated by the cold air circulation fan 12 is blown out through the right and left forward-facing cold air outlets 16, 16 and approximately one third thereof is blown out through the downward-facing cold air outlet 17. With regard to this approximately one-third of the cold air amount to be blown out through the downward-facing cold air outlet 17, approximately balanced amounts are blown out from the right and left outlet parts 17A and the central outlet part 17B. As a result, temperature variations in all areas from the upper part to the lower part of the interior 2A fall within the predetermined temperature variation range (±3° C. in this embodiment) with respect to the preset temperature (5° C. in this embodiment).

An outlet configuration according to another embodiment of the disclosed technique will be described next. If a drug refrigerator requiring less-stringent temperature control, for example, an interior temperature fluctuation range of 5° C.±5° C., is already on the market when providing a drug refrigerator requiring temperature control with a small fluctuation range in interior temperature, for example, the preset temperature 5° C.±3° C., this outlet configuration eliminates the manufacturing cost of a new mold and thereby achieves a cost reduction by making efficient use of the outlet member 18 of this conventional (existing) drug refrigerator while providing the drug refrigerator 1 requiring temperature control with a small fluctuation range in interior temperature, for example, the preset temperature 5° C.±3° C.

Figure 8:
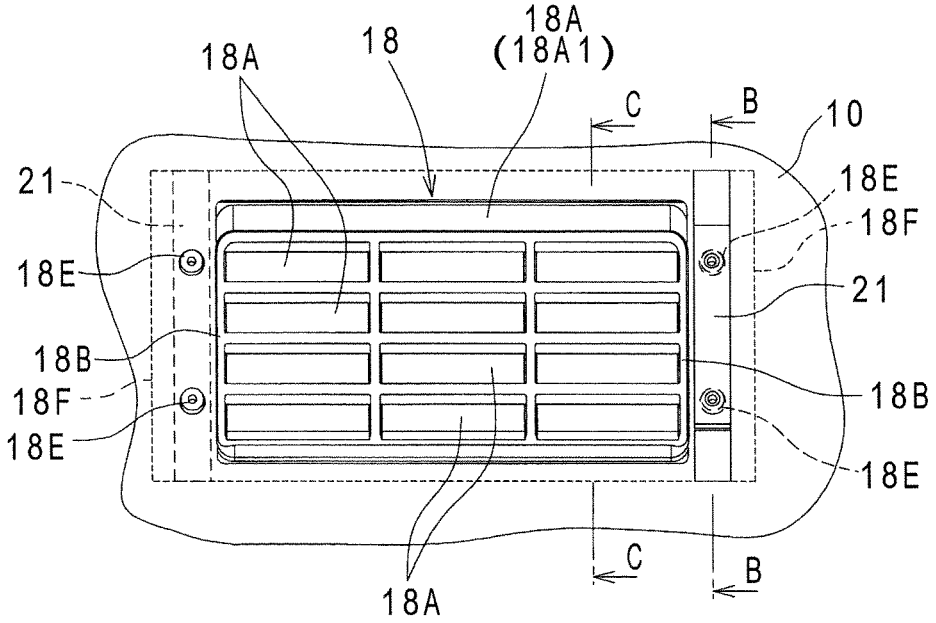
FIG. 8 is a back view for explaining an attachment state of a forward-facing cold air outlet according to another embodiment.
Figure 9:
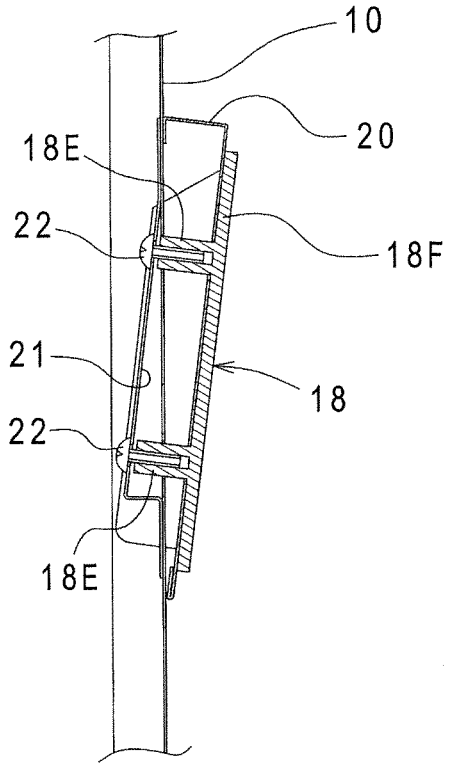
FIG. 9 is a cross-sectional view taken along line B-B in FIG. 8.
Figure 10:
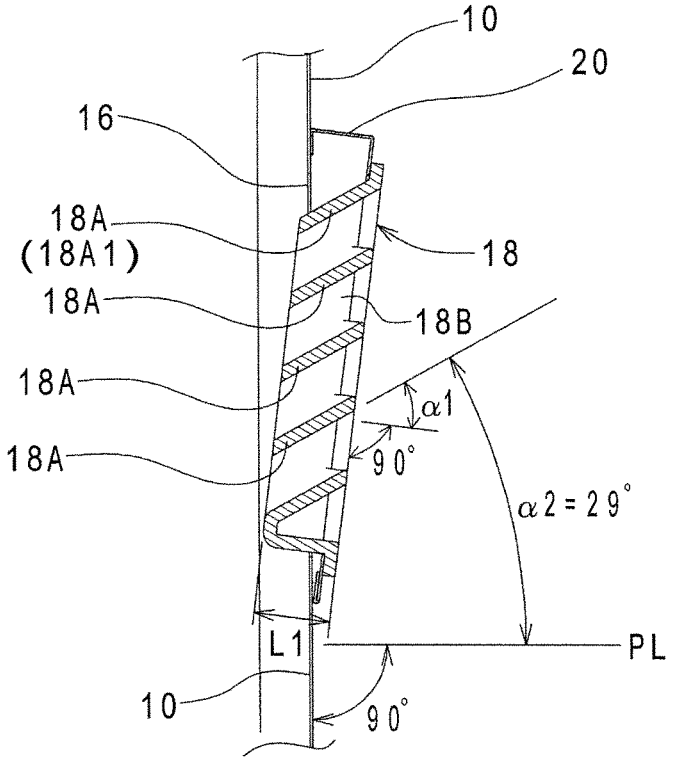
FIG. 10 is a cross-sectional view taken along line C-C in FIG. 8.

Specifically, as shown in FIGS. 8 to 10, the outlet member 18 of the aforementioned conventional drug refrigerator has a rectangular shape with a thickness L1 in the front-back direction. In the thickness L1, the plurality of obliquely-upward wind-directing plates 18A are provided at a predetermined obliquely-upward angle α1 so as to be parallel to each other in the horizontal direction at predetermined intervals in the vertical direction with the right and left edges thereof being fixed to the frame part 18B. This outlet member 18 is made of a synthetic resin.

Figure 12:
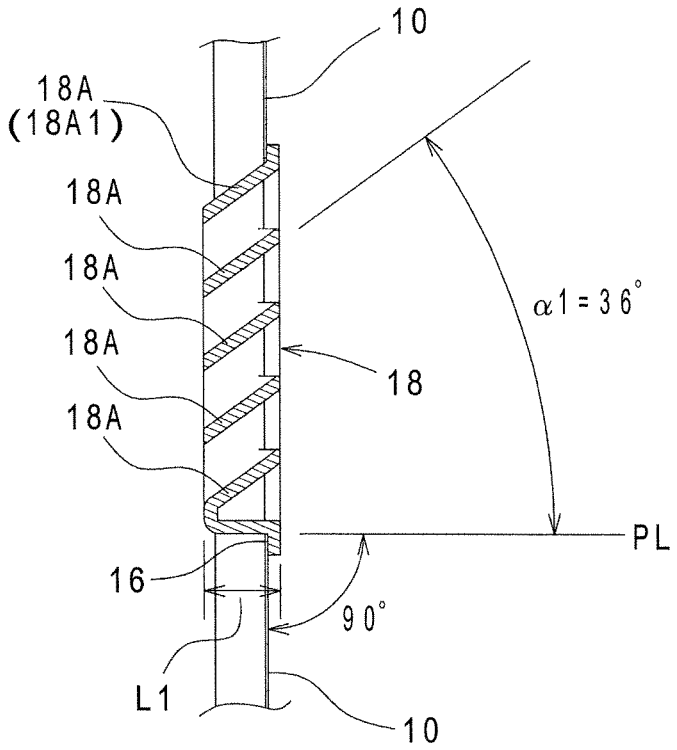
FIG. 12 is a vertical cross-sectional side view illustrating an attachment state of an outlet member employed in an existing drug refrigerator.

As shown in FIG. 12, the outlet member 18 may be approximately vertically attached as it is (without providing an angle changing member 20 to be described later) to the forward-facing cold air outlet 16 formed in the vertical partition plate 10 so as to be in an approximately vertical state in the vertical partition plate 10 in an approximately vertical state as with the state when being attached to the conventional drug refrigerator. According to this method, the blowing-out direction of the cold air blown out upward into the interior 2A from the outlet member 18 forms an elevation angle α1. While this is a preferred angle in the conventional drug refrigerator, such an angle fails to achieve a predetermined temperature fluctuation range in the drug refrigerator 1 to be the subject of the disclosed technique requiring temperature control with a small fluctuation range in interior temperature, for example, the preset temperature 5° C.±3° C. The elevation angle α1 is shown by an upward angle with respect to a horizontal plane PL (when the vertical partition plate 10 is in a vertical state, the horizontal plane forms an angle of 90 degrees thereto in the attached state in FIG. 12).

Thus, in the disclosed technique, on the premise of utilizing the outlet member 18 employed in the aforementioned conventional drug refrigerator, a means for setting the cold air blowing-out direction by the wind-directing plates 18A in a preferred state is employed to provide the drug refrigerator 1 requiring temperature control with a small fluctuation range in interior temperature.

According to the disclosed technique, the outlet member 18 is attached to the forward-facing cold air outlet 16 via the angle changing member 20 whose entire perimeter abuts against the rim of the forward-facing cold air outlet 16 so that the wind-directing plate 18A forms an obliquely-upward angle (elevation angle α2) smaller than the predetermined obliquely-upward angle (elevation angle α1). Therefore, the angle changing member 20 has a shape with the upper part thereof being projected more toward the interior 2A side than the lower part thereof. By attaching the angle changing member 20 such that the entire perimeter thereof abuts against the rim of the forward-facing cold air outlet 16 and by attaching the outlet member 18 to the front face of the angle changing member 20, the elevation angle α1, which is the obliquely-upward angle of the wind-directing plate 18A, is changed to the obliquely-upward angle (elevation angle α2) smaller than the predetermined angle. The elevation angle α1 is shown by the upward angle with respect to the horizontal plane PL (when the vertical partition plate 10 is in a vertical state, the horizontal plane forms an angle of 90 degrees thereto in the attached state in FIG. 12). The angle obtained by changing the elevation angle α1 to a smaller elevation angle by the angle changing member 20 is the elevation angle α2.

As shown in FIGS. 8 to 10, the attachment of the outlet member 18 to the forward-facing cold air outlet 16 is performed by: disposing the angle changing member 20 on the front face side of the forward-facing cold air outlet 16 such that the entire perimeter thereof abuts against the rim of the forward-facing cold air outlet 16; setting the outlet member 18 so as to abut against the front face of the angle changing member 20; disposing attachment plates 21 on the right and left sides on the back side of the vertical partition plate 10 as shown in FIG. 8; and while keeping such a state, screwing attachment screws 22 running through the attachment plates 21 with attachment bosses 18E extending rearward from right and left flange parts 18F of the outlet member 18. Consequently, as shown in FIGS. 9 and 10, the outlet member 18 is stably fixed to the forward-facing cold air outlet 16 with the outlet member 18 and the angle changing member 20 being pulled toward the vertical partition plate 10.

Consequently, as shown in FIG. 10, the blowing-out direction of the cold air blown out upward into the interior 2A through the outlet member 18 is changed to the obliquely-upward angle α2 smaller than the predetermined obliquely-upward angle α1, so that the blowing-out angle of the cold air blown out obliquely upward into the interior 2A is modified to a smaller angle. Along with this, the wind-directing plates 18A are configured such that the upper wind-directing plates 18A are incrementally projected more toward the interior 2A side than the lower wind-directing plates 18A. Thus, part of the cold air flowing downward in the cooling chamber 11 is blown out obliquely upward into the interior 2A toward the range from the middle part to the upper part of the door 4 along the wind-directing plates 18A with the preferred angle α2.

In this case, due to the forward projection of the uppermost wind-directing plate 18A1, the blown-out cold air is guided forward, thereby increasing a path of the cold air blown out through the forward-facing cold air outlet 16 before being sucked into the cold air inlet 15. Thus, the cold air blown out through the forward-facing cold air outlet 16 is prevented from being sucked into the cold air inlet 15 due to short circuit. This is therefore preferable for the purpose of uniformly cooling the interior 2A and temperature variations in all areas from the upper part to the lower part of the interior 2A fall within the predetermined temperature variation range (±3° C. in this embodiment) with respect to the preset temperature (5° C. in this embodiment).

As one example of the preferred form in the drug refrigerator 1 according to the above-described embodiment, the blowing-out angle of the cold air blown out by the plurality of wind-directing plates 18A directed obliquely upward at the predetermined angle (elevation angle α1) in the outlet member 18 itself is the elevation angle α1of 36 degrees in this embodiment as shown in FIG. 12. On the other hand, as shown in FIGS. 9 and 10, the smaller angle changed by the angle changing member 20 is the elevation angle α2of 29 degrees in this embodiment. Consequently, the cold air can be successfully blown out obliquely upward toward the range from the middle part to the upper part of the door 4. The cold air thus blown out obliquely upward into the interior 2A through the outlet member 18 is prevented from being sucked into the cold air inlet 15 due to short circuit. Thus, temperature variations in all areas from the upper part to the lower part of the interior 2A fall within the predetermined temperature variation range (±3° C. in this embodiment) with respect to the preset temperature (5° C. in this embodiment).

As described above, if a drug refrigerator 1 requiring less-stringent temperature control, for example, an interior temperature fluctuation range of 5° C.±5° C., is already on the market when providing the new drug refrigerator 1 requiring temperature control with a small fluctuation range in interior temperature, for example, the preset temperature 5° C.±3° C., a cost reduction can be achieved in the new drug refrigerator 1 by employing the synthetic resin outlet member 18 same as that used in the conventional drug refrigerator 1 and applying the outlet member 18 to the new drug refrigerator 1.

For this purpose, the angle changing member 20 is manufactured and the outlet member 18 employed in the conventional drug refrigerator 1 as shown in FIGS. 8 to 10 is attached via the angle changing member 20 as described above. This eliminates a need to newly manufacture the outlet member 18 for the new drug refrigerator 1, thereby suppressing the manufacturing cost of the mold for molding the outlet member 18 and therefore achieving a cost reduction. This also allows for the provision of the drug refrigerator 1 requiring temperature control with a small fluctuation range in interior temperature, for example, the preset temperature 5° C.±3° C.

The above-described embodiment takes the form of the drug refrigerator 1 with a freezer and the refrigeration device 50 includes a cooler for cooling the freezer F in parallel to the cooler 8 for cooling the drug refrigerator part R. As described above, the drug refrigerator part R employs the indirect cooling system with which cold air cooled by the cooler 8 is circulated into the interior 2A by the cold air circulation fan 12. On the other hand, the freezer F is cooled at a low temperature between −20° C. and −30° C. and the cooler for cooling the freezer F employs what is called a direct cooling system with which the cooler forms the whole or part of the inner wall of the freezer F. A front-face opening of the freezer F is configured to be opened or closed by a double door 25 which opens toward right and left.

Advantageous effects and the like of the drug refrigerator according to the disclosed technique will now be described.

The drug refrigerator 1 of the disclosed technique includes: the refrigerator body 2 with an approximately rectangular parallelepiped shape having the front-face opening 3 on the front face thereof and having a heat insulating property; the door 4 capable of opening and closing the front-face opening 3; the vertical partition plate 10 for forming the cooling chamber 11 in the vertical direction along the back wall 2H of the refrigerator body 2 in the back part of the interior 2A of the refrigerator body 2; the cooler 8 housed in the cooling chamber 11; and the cold air circulation fan 12 provided at a position higher than the cooler 8 in the cooling chamber 11, the cold air circulation fan circulating cold air cooled by the cooler 8 into the interior 2A. The vertical partition plate 10 is provided with: the cold air inlet 15 disposed at a position facing the cold air circulation fan 12, the cold air being sucked in through the cold air inlet 15 in the interior 2A by the cold air circulation fan 12; the right and left forward-facing cold air outlets 16 disposed at right and left positions lower than the cooler 8, the cold air being blown out through the forward-facing cold air outlets 16 toward the front part of the interior 2A; and the downward-facing cold air outlet 17 disposed at a position lower than the forward-facing cold air outlets 16, the cold air being blown out through the downward-facing cold air outlet 17 toward the bottom part of the interior 2A from the lower part of the cooling chamber 11. The forward-facing cold air outlets 16 are formed larger than the downward-facing cold air outlet 17 such that the circulation amount of the cold air blown out through the forward-facing cold air outlets 16 is greater than the circulation amount of the cold air blown out through the downward-facing cold air outlet 17.

According to the disclosed technique, even when a part or a large part of the door 4 is formed by a glass window as well as when the entire door 4 is made of a heat-insulating door, it is possible to achieve the configuration of the cold air circulation path with which temperatures in the respective areas of the interior 2A fall within the predetermined temperature fluctuation range, for example, the preset temperature ±3° C. Also, a state with a small temperature fluctuation can be obtained in each of the areas of the interior 2A and the drug refrigerator requiring temperature control with a small fluctuation range in interior temperature can be thereby achieved. Thus, this is preferable as a drug refrigerator suitable for cooling and storing vaccines and the like.

Moreover, the outlet member 18 to be attached to the forward-facing cold air outlet 16 and having the plurality of wind-directing plates 18A for controlling the cold air blown out through the forward-facing cold air outlet 16 is included. At least a part of the forward-facing cold air outlet 16 is provided at a position lower than the center of the interior 2A in the vertical direction. The plurality of wind-directing plates 18A are inclined upward at a predetermined angle toward the range from the center to the upper part of the door 4 in the vertical direction so that the direction of the blown-out cold air is directed obliquely upward.

Consequently, the drug refrigerator 1 requiring temperature control with a small fluctuation range in the temperature of the interior 2A can be further achieved. Thus, this is preferable as a drug refrigerator suitable for cooling and storing vaccines and the like.

Moreover, the downward-facing cold air outlet 17 is formed such that the portions corresponding to the areas under the right and left forward-facing cold air outlets 16 each have a larger area and the portion corresponding to the area between the right and left forward-facing cold air outlets 16 has a narrower area in order to make the amount of cold air blown out from the entire horizontal width thereof approximately balanced across the horizontal width of the interior 2A.

Consequently, the amount of cold air blown out from the entire horizontal width of the downward-facing cold air outlet 17 is approximately balanced across the horizontal width of the interior 2A, thereby preventing the bottom part of the interior 2A from being overcooled.

Moreover, the plurality of wind-directing plates 18A are formed such that the upper wind-directing plates 18A are incrementally projected more toward the interior 2A side than the lower wind-directing plates 18A.

Consequently, due to the forward projection of the uppermost wind-directing plate 18A, the blown-out cold air is guided forward, thereby increasing a path of the cold air blown out through the forward-facing cold air outlet 16 before being sucked into the cold air inlet. Thus, the cold air blown out through the forward-facing cold air outlet 16 is prevented from being sucked into the cold air inlet due to short circuit. This is therefore preferable for the purpose of uniformly cooling the interior 2A.

Moreover, the angle changing member 20 to be provided between the forward-facing cold air outlet 16 and the outlet member 18 is included. The angle changing member 20 is attached to the forward-facing cold air outlet 16 so that the entire perimeter of the angle changing member 20 abuts against the rim of the forward-facing cold air outlet 16 with the inclination angle of the plurality of wind-directing plates 18A being kept at an angle changed more downward than the predetermined angle.

In order to utilize the existing outlet member 18 used in the drug refrigerator already being manufactured for sales, the existing outlet member 18 is attached to the forward-facing cold air outlet 16 via the angle changing member 20. This makes it possible to reduce the cost of the drug refrigerator.

Moreover, the forward-facing cold air outlets 16 are formed at the right and left positions outside the area directly under the cold air inlet. The downward-facing cold air outlet 17 includes: the central outlet part 17B corresponding to the area directly under the cold air inlet; and the right and left outlet parts 17A corresponding to the areas under the right and left forward-facing cold air outlets 16. The right and left forward-facing cold air outlets 16 and the downward-facing cold air outlet 17 are disposed in the third area, which is the third quarter from the top when the vertical dimension of the interior 2A is quartered.

Consequently, in the central portion, the cold air passing through the cooler 8 and flowing downward in the cooling chamber 11 by the cold air circulation fan 12 flows downward between the right and left forward-facing cold air outlets 16 and blows out downward through the central outlet part 17B. In the right and left portions, a majority of such cold air blows out through the right and left forward-facing cold air outlets 16 and the remaining amount blows out downward through the right and left outlet parts 17A. Consequently, the amount of the cold air blown out downward through the central outlet part 17B and the amount of the cold air blown out downward through the right and left outlet parts 17A are approximately balanced, thereby approximately balancing the amount of the cold air blown out from the entire horizontal width of the downward-facing cold air outlet 17 across the horizontal width of the interior 2A. Thus, temperatures near the downward-facing cold air outlet 17 and in the lower area of the interior 2A are approximately homogenized.

REFERENCE SIGNS LIST

1 drug refrigerator
2 heat-insulating refrigerator body
2A interior
3 opening on front face
4 door
4A glass window
5 heat-insulating partition wall
6 compressor
7 condenser
8 cooler
9 heat release fan
10 vertical partition plate
11 cooling chamber
12 cold air circulation fan
13 control part
15 cold air inlet
16 forward-facing cold air outlet
17 downward-facing cold air outlet
17A right and left outlet parts
17B central outlet part
18 outlet member
18A wind-directing plate
20 angle changing member
21 attachment plate
22 attachment screw
50 refrigeration device

The invention claimed is:

1. A drug refrigerator comprising:

a refrigerator body with an approximately rectangular parallelepiped shape having an opening on a front face thereof and having a heat insulating property;

a door capable of opening and closing the opening;

a vertical partition plate for forming a cooling chamber extending in a vertical direction along a back wall of the refrigerator body in a back part of an interior of the refrigerator body;

a cooler housed in the cooling chamber; and a cold air circulation fan provided at a position higher than the cooler in the cooling chamber, the cold air circulation fan circulating cold air cooled by the cooler into the interior, wherein:

the vertical partition plate is provided with:

a cold air inlet disposed at a position facing the cold air circulation fan, the cold air being sucked in through the cold air inlet in the interior by the cold air circulation fan; and two forward-facing cold air outlets disposed at right and left positions lower than the cooler, the cold air being blown out through the forward-facing cold air outlets toward a front part of the interior, the cooling chamber includes a downward-facing cold air outlet disposed at a position lower than the forward-facing cold air outlets, the cold air being blown out through the downward-facing cold air outlet toward a bottom part of the interior from a lower part of the cooling chamber, and the forward-facing cold air outlets are formed larger than the downward-facing cold air outlet such that a circulation amount of the cold air blown out through the forward-facing cold air outlets is greater than a circulation amount of the cold air blown out through the downward-facing cold air outlet, the drug refrigerator further comprises an outlet member attached to each of the forward-facing cold air outlets and having a plurality of wind-directing plates for controlling the cold air blown out through each of the forward-facing cold air outlets, at least a part of each of the forward-facing cold air outlets is provided at a position lower than a center of the interior in a vertical direction, and the plurality of wind-directing plates are inclined at a predetermined angle toward a range from a center to an upper part of the door in the vertical direction such that a direction of the blown-out cold air is directed obliquely upward.

2. The drug refrigerator according to claim 1, wherein the downward-facing cold air outlet is formed such that a portion corresponding to an area under each of the forward-facing cold air outlets has a larger area and a portion corresponding to an area between the forward-facing cold air outlets has a narrower area in order to make an amount of cold air blown out from an entire horizontal width thereof approximately balanced across a horizontal width of the interior.

3. The drug refrigerator according to claim 2, wherein the plurality of wind-directing plates are formed such that upper wind-directing plates are incrementally projected more toward the interior side than lower wind-directing plates.

4. The drug refrigerator according to claim 2, further comprising an angle changing member to be provided between each of the forward-facing cold air outlets and the outlet member, wherein the angle changing member is attached to each of the forward-facing cold air outlets such that an entire perimeter of the angle changing member abuts against a rim of the each of the forward-facing cold air outlets with the inclination angle of the plurality of wind-directing plates being kept at an angle changed more downward than the predetermined angle.

5. The drug refrigerator according to claim 2, wherein:

the forward-facing cold air outlets are formed at the right and left positions outside an area directly under the cold air inlet, the downward-facing cold air outlet includes:

a central outlet part corresponding to the area directly under the cold air inlet; and right and left outlet parts corresponding to the areas under the forward-facing cold air outlets, and the forward-facing cold air outlets and the downward-facing cold air outlet are disposed in a third area, which is a third quarter from a top when a vertical dimension of the interior is quartered.

6. The drug refrigerator according to claim 1, wherein the plurality of wind-directing plates are formed such that upper wind-directing plates are incrementally projected more toward the interior side than lower wind-directing plates.

7. The drug refrigerator according to claim 1, further comprising an angle changing member to be provided between each of the forward-facing cold air outlets and the outlet member, wherein the angle changing member is attached to each of the forward-facing cold air outlets such that an entire perimeter of the angle changing member abuts against a rim of the each of the forward-facing cold air outlets with the inclination angle of the plurality of wind-directing plates being kept at an angle changed more downward than the predetermined angle.

* * * * *